US005138836A

United States Patent [19]

Pfister

[11] Patent Number: 5,138,836

[45] Date of Patent: Aug. 18, 1992

[54] PARTICLE FILTER THAT CAN BE REGENERATED BY BURNING FREE FOR THE EXHAUST GASES OF INTERNAL COMBUSTION ENGINES

[75] Inventor: Wolfgang Pfister, Esslingen, Fed. Rep. of Germany

[73] Assignee: Eberspächer, Esslingen, Fed. Rep. of Germany

[21] Appl. No.: 747,664

[22] Filed: Aug. 20, 1991

[30] Foreign Application Priority Data

Aug. 21, 1990 [DE] Fed. Rep. of Germany ..... 4026375

[51] Int. Cl.[5] ..... F01N 3/02

[52] U.S. Cl. ..... 60/311; 60/303; 60/295; 55/466; 55/484

[58] Field of Search ..... 60/274, 303, 311, 286, 60/295; 55/466, 484, DIG. 30

[56] References Cited

U.S. PATENT DOCUMENTS

| | | | |
|---|---|---|---|
| 4,925,463 | 5/1990 | Kuhnert | 55/96 |
| 5,024,249 | 8/1991 | Erdmannsdoerfer | 60/299 |
| 5,065,574 | 11/1991 | Bailey | 60/274 |

*Primary Examiner*—Ira S. Lazarus
*Assistant Examiner*—L. Heyman
*Attorney, Agent, or Firm*—McGlew & Tuttle

[57] ABSTRACT

A particle filter that can be burned free for cleaning the exhaust gas of internal combustion engines. Filter cartridges (11) are provided arranged in a housing (1) with an external heat supply (10). The filter cartridges are lined with filter material (13) differently, corresponding to the flow profile of the exhaust gas in the housing.

5 Claims, 3 Drawing Sheets

PARTICLE FILTER THAT CAN BE REGENERATED BY BURNING FREE FOR THE EXHAUST GASES OF INTERNAL COMBUSTION ENGINES

FIELD OF THE INVENTION

The present invention pertains to a particle filter for cleaning the exhaust gas of internal combustion engines, with filter cartridges which are arranged between mounting plates in a housing provided with an inlet chamber and an outlet funnel and are formed by a support tube that is provided with exhaust gas passage openings and is lined with filter material, and to which additional heat for regeneration by burning free is supplied from a heat source.

BACKGROUND OF THE INVENTION

Such particle filters are needed to clean exhaust gases of internal combustion engines, especially in vehicles operated with diesel fuel, in order to filter out the soot particles which are hazardous for health and represent major and dangerous environmental pollution. These particle filters have been known in a plurality of designs. In one design, the exhaust gas is filtered while passing through a ceramic block (monolith) that has a plurality of passage canals, of which one canal is closed on the inlet side and another is closed on the outlet side in a checkerboard pattern, so that the exhaust gas will flow into one canal, after which it will flow into the adjacent canal through the surrounding monolith section acting as the filter, and will leave the latter canal freed from soot particles. Such a soot filter is disclosed in German Offenlegungsschrift No. DE-0S 32,17,357.

Filter cartridges are used to filter out particles in another embodiment. These filter cartridges are preferably designed as wound filters. A plurality of layers of filter material are wound around a support tube provided with exhaust gas outlet openings, so that an element comparable to a textile thread spool is obtained. Another arrangement is shown in German Offenlegungsschrift No. DE-OS 38,15,148, with special representation of the mounting of the filter cartridges in mounting plates. The filter cartridges can also be formed by a tube of filter material pulled over a support tube corresponding to West German Offenlegungsschrift No. DE-OS 38,23,205. The filter cartridges are passed through from the outside to the inside. The exhaust gas to be cleaned enters the support tubes, which are closed on the inlet side, through the filter material. The soot particles are retained during flow through the wound filter material, and the cleaned exhaust gas flows through the support tubes and into the outlet funnel, and is discharged there. The filter cartridges are arranged on concentric circles in the filter housing and have a uniform design. Instead of the inlet-side mounting plate provided with exhaust gas passage openings, it is also possible to provide a mounting grid.

During the operation of the internal combustion engine, soot buildup takes place during the flow through the particle filter, i.e., the filter material increasingly becomes clogged with soot particles, and the soot must be removed after a relatively short operating time. Mechanical removal is practically ruled out, because it would require disassembly of the entire filter and removal of the soot. Therefore, it is necessary to resort to burning free the accumulated soot. To do so, oxidizing agents are added as additives to the exhaust gas from a supply container, so that the soot collected comes into contact with these agents, which lower the ignition point of the soot and increase the rate of combustion, and it can be burned off at relatively low exhaust gas temperatures. However, this type of burning free of the soot collected has the disadvantage that the additives are readily inflammable chemical compounds and introduce into the exhaust gas undesirable components, whose environmental safety has not yet been proven. Attempts have therefore been made to connect a diesel burner as an external heat source, but it was unable to regenerate the filters with the prior-art arrangement during the driving operation of the vehicle. Therefore, very large filters are needed with this solution in order to reach a storage capacity that permits longer travel between the regeneration cycles. This resting-time regeneration is possible in vehicles operated intermittently, e.g., buses in municipal transportation systems. In other vehicles, the regeneration must be performed during driving operation. Therefore, e.g., two filters are arranged in parallel to one another, and one of the two filters is being regenerated at any given time.

In devices with only one particle filter having a plurality of filter cartridges, it is also known that for "regeneration during driving operation", an external heat source is connected as soon as a heavier coating with soot particles can be determined, e.g., from the exhaust gas back pressure, and this external heat source heats the exhaust gas to be cleaned sufficiently (>600° C.) so that the burning-free process can take place. However, it was found that the filter cartridges are not burned free over their entire length, especially in the case of loads involving a weak exhaust gas mass flow. This is due to the fact that even burning free of approximately the front half of the filter cartridges ensures a sufficiently low flow resistance, so that there is no sufficient flow through the rear part or the outermost filter cartridges. This incomplete regeneration leads to progressively shorter soot buildup times, which can lead to failure of the filter in the worst case. Experiments have shown that the soot buildup time decreased from, e.g., 135 minutes after the first soot build-up to 15–20 minutes.

In order to bring about a substantial improvement in regeneration burning free, an improvement of burning free was achieved according to German patent application No. P 40,04,861.6, which was not previously published, by arranging in the space between the filter cartridges so-called overflow tubes, via which the exhaust gas to be cleaned is fed to the filter cartridges such that uniform admission over the entire length of the filter cartridges is achieved.

A device of this type has become known from DE 38,36,697 Al, in which the mounting plates together with the filter cartridges form a rotatable drum, so that one segment of this drum can be brought at any time into a zone in which the burning-free takes place. Such a device is very complicated, especially in terms of the mounting of the rotatable drum and the sealing to prevent bypass flow of uncleaned exhaust gas. These problems will be solved in this document. However, such devices with segment-by-segment free-burning are not suitable for mass production installation.

SUMMARY AND OBJECTS OF THE INVENTION

Based on this state of the art, a primary object of the present invention is to provide a particle filter which permits regeneration during driving and in which a high degree of burning free over the entire filter length exposed to exhaust gas is achieved, so that the repeated soot buildup is approximately constant, and corresponds to the first time soot buildup.

The primary object of the invention is achieved based on the discovery that the exhaust gas flows through the filter with a defined flow profile and that the soot buildup in the filter corresponds to this flow profile.

According to the invention, a particle filter of the general type described in the introduction, is provided in which filter cartridges with different active lengths are arranged in an equidistant distribution over the cross section of the housing. The "active length" is defined as the section of the filter cartridge covered with filter material. A different active length can be achieved by making the filter material lining different over the length of the filter cartridge, e.g., by making it thicker in the front when viewed in the flow direction than in the zone following it. This lining of varying thickness may be different in the individual filter cartridges; for example, different linings can be selected in the edge zone of the filter and in the central (middle) zone. The thickness of the lining may be selected corresponding to the flow profile of the exhaust gas to be cleaned.

A particularly useful variant of the invention is characterized in that the support tubes are lined with filter material over different longitudinal extensions. It is achieved with this arrangement that the filter cartridges designed as wound filters can be manufactured in a simple and proven process, in the same manner, and the filter cartridges can be inserted into flat mounting plates in the filter housing due to the identical length of the support tubes. According to another embodiment, the filter cartridges are arranged corresponding to the flow profile of the exhaust gas flowing through, i.e., the filter cartridges with the shorter active length are arranged in the radially external part of the housing. In a preferred arrangement according to the invention support tubes are lined over different lengths, the support tubes lined with filter material over a short length are arranged in the outer, radially more remote zone of the housing. It is thus possible to adjust the inner filter geometry to the actually existing streamline field in the filter and in order for the regeneration of the exhaust gas by burning free the particles having collected in the filter to take place uniformly over the entire filter area by using a reduced amount of filter material. To burn free the particles, heat generated externally is fed in at least from time to time, e.g., via a burner arranged on the filter housing, as is known from, e.g., the so-called space heaters or auxiliary heaters for vehicles.

These advantageous and useful further embodiments of the present invention provide, at least in some instances, alone or in combination, independent inventive characteristics.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
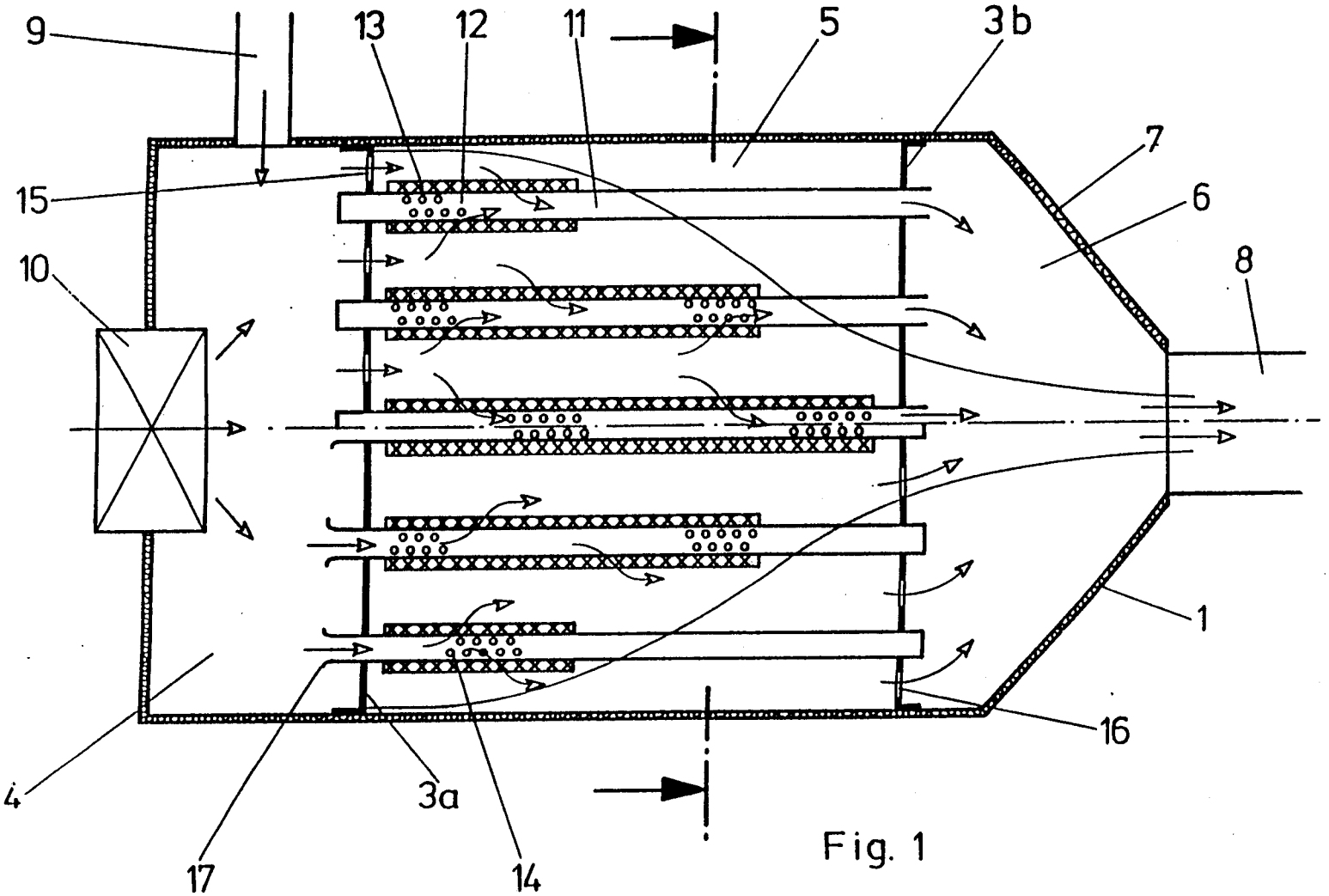
FIG. 1 is a longitudinal sectional view through a particle filter with different possibilities of exhaust gas routing, which are represented in the upper and lower halves.
Figure 2:
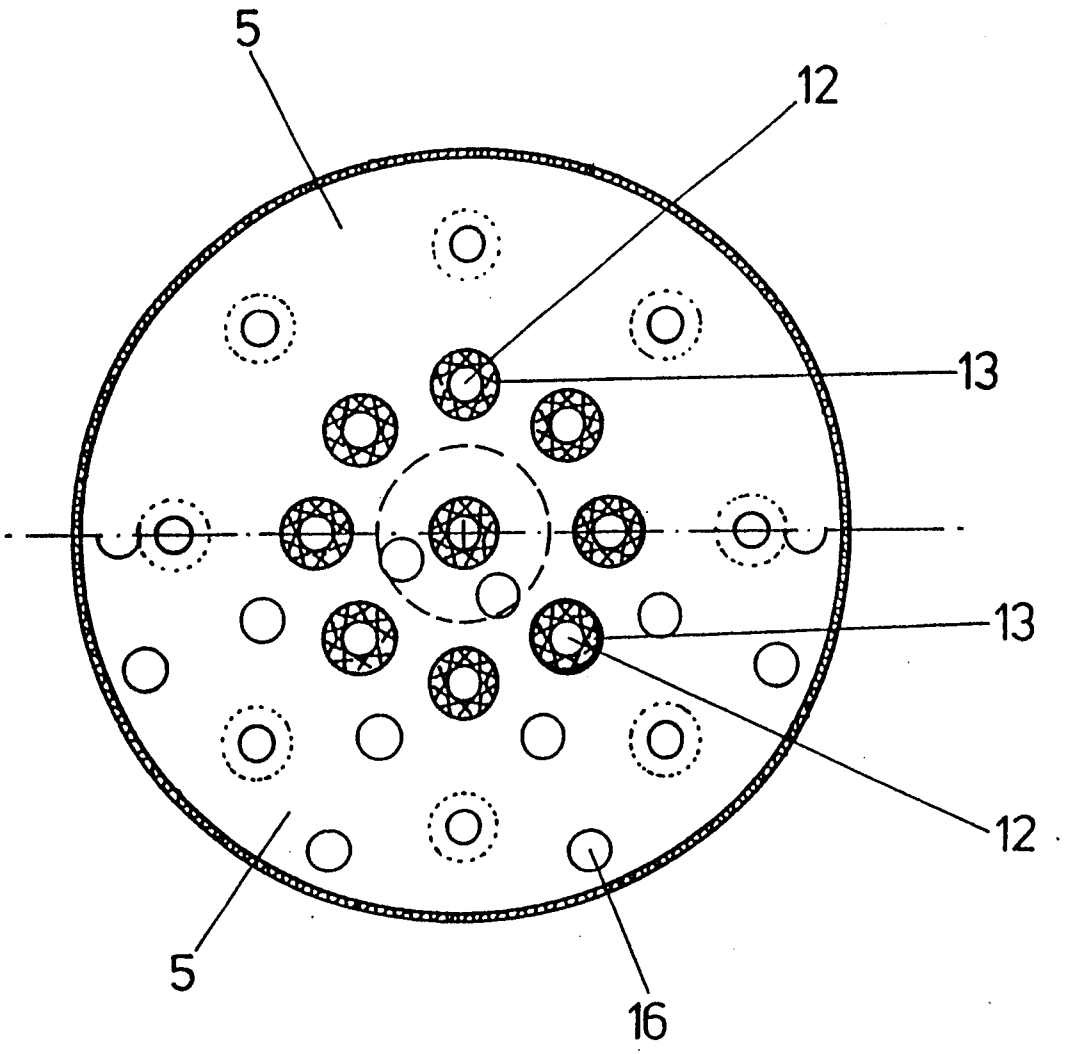
FIG. 2 is a cross sectional view taken along line II—II of FIG. 1.

Two variants are shown in the example of the particle filter represented in FIG. 1. The top part of FIG. 1 shows an arrangement in which the exhaust gas to be cleaned is fed to the filter material via the filter chamber, and in the representation shown in the lower half, the exhaust gas is fed to the filter cartridges via the support tubes. The design shown in the upper half is a preferred arrangement.

FIG. 1 shows a housing 1 with thermal insulation 4, which is needed to maintain the burning-free temperature with the lowest possible energy supply and in order to protect the components surrounding the filter. The housing 1 is subdivided into three chambers by an upstream-side holding element or mounting plate 3*a*, which is arranged rigidly in the housing 1, and a downstream-side holding element or mounting plate 3*b*, which is preferably arranged with a sliding fit. The upstream-side inlet chamber 4, which is designed as a mixing chamber, is followed, in the downstream direction, by the filter chamber 5 between the mounting plates 3*a* and 3*b*, and by the following outlet chamber 6, which is provided with an outlet funnel 7, and this is followed by an exhaust gas outlet pipe connection 8. The exhaust gas to be cleaned is admitted into the inlet chamber 4 radially or even tangentially via an exhaust gas inlet pipe connection 9. The external heat needed is also admitted into the inlet chamber 4 via the connection 10, which also acts in this embodiment as a suitable burner as is known from, e.g., German Offenlegungsschrift No. DE-OS 34,10,716.9 (Corresponding to U.S. Pat. No. 4,650,415 and 4,669,973). One example of an external heat supply is shown, e.g., in German Offenlegungsschrift No. DE-OS 35,45,437.7 (Corresponding to U.S. Ser. No. 07/449,966). The filter cartridges 11 are arranged between the holding elements 3*a*, 3*b*. These filter cartridges 11 consist of a support tube 12, which is provided with filter material 13 in the form of, e.g., a ceramic ring winding. The support tubes 12 have perforations 14 for the passage of the exhaust gas at least in the area of the coverage with the filter material 13. The support tubes 12 are rigidly mounted in the mounting plate 3*a*. The other end of the support tubes 12 is also rigidly mounted in the mounting plate 3*b* if the mounting plate 3*b* is arranged in the housing 1 with a sliding fit, or it is mounted in the mounting plate 3*b* with a sliding fit if the mounting plate 3*b* is also rigidly arranged in the housing 1. This mounting, which is movable on one side, is necessary in order to absorb the change in the length of the support tube 12, which is brought about by the thermal effect, during the free-burning process.

The exhaust gas to be cleaned is fed via the exhaust gas inlet pipe connection 9 into the inlet chamber 4, into which additional heating is also supplied via the external heat supply 10. There are two possibilities for admitting the exhaust gas into the filter chamber 5. The preferred "flow from the outside to the inside" through the filter cartridges 11 is shown in the top part of FIG. 1. The exhaust gas to be cleaned, which is loaded with soot particles, enters the filter chamber 5 here from the inlet chamber 4 via inlet openings 15 arranged in the mounting plate 3*a*. This filter chamber 5 is closed in the downstream direction by the mounting plate 3*b*, so that the exhaust gas enters the support tube 12 via the perforation 14 through the filter material 13, and leaves the support tube 12, which is open in the downstream direction, in the cleaned state, thus entering the outlet chamber 6, and it is removed via the exhaust gas outlet pipe connection 8.

The "flow from the inside to the outside" through the filter cartridges 11 is shown as a variant in the lower half of FIG. 1. In an otherwise identical arrangement, the holding bottom 3*a*, which is on the outside from the viewpoint of flow, is designed as a closed bottom in this embodiment, while the downstream holding bottom 3*b* has outlet openings 16, and the support tubes 12, which are open on the outlet side in the other embodiment, are closed here, so that the exhaust gas flowing into the support tubes 12, which are open on the inlet side, flows through the filter material 13 in the outward direction and into the filter chamber 5, and is removed via the outlet openings 16. The support tubes 12, which are open on the inlet side, may have an inlet bell 17 made in one piece with them in order to improve the inflow of the exhaust gas.

Figure 3:
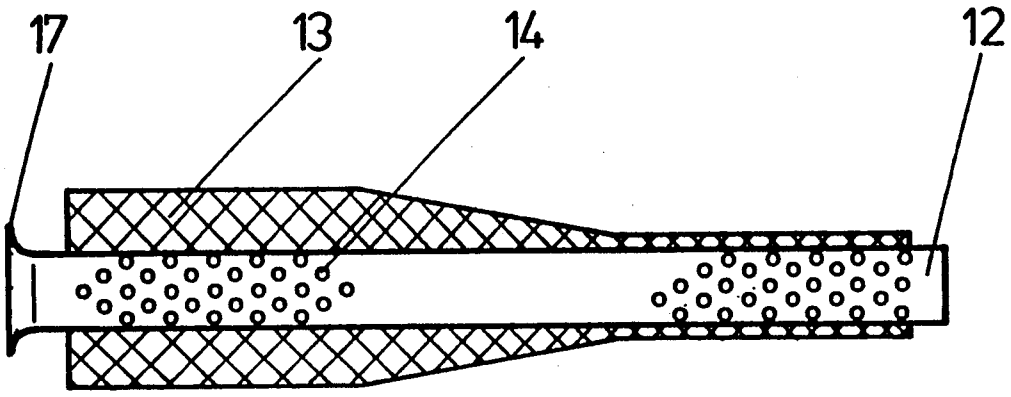
FIG. 3 is a filter cartridge with variants of the filter material lining.

FIG. 3 shows a variant of a filter cartridge 11. In this variant, the different active lengths of the filter cartridge 11 are brought about by applying the filter material 13 in different thicknesses over the length of the support tube 12 to the support tube 12, which is provided with an inlet bell 17 made in one piece with it in this example. In this example, the support tube 12 is provided with the thickest lining of filter material in the section that is the first section in the downstream direction, and this is gradually followed, in the second section, by a transition to a thinner filter material lining in the last section. Such filter cartridges 11 are preferably used in particle filters for vehicles that have load states involving weak exhaust gas mass flows or greatly varying mass flows.

While specific embodiments of the invention have been shown and described in detail to illustrate the application of the principles of the invention, it will be understood that the invention may be embodied otherwise without departing from such principles.

What is claimed is:

1. A particle filter for cleaning the exhaust of an internal combustion engine, comprising: a housing provided with an inlet and an outlet funnel spaced from said inlet; a first mounting plate positioned adjacent said inlet and cooperating with said housing to define an inlet chamber; a second mounting plate positioned in said housing adjacent said outlet; a plurality of filter cartridges, each of said filter cartridges including a support tube provided with exhaust gas passage openings, each said support tube being supported by said first mounting plate and said second mounting plate and being arranged distributed over a cross section of said housing, each of said filter cartridges including filter material, said filter cartridges being provided with different active lengths, said active length depending upon the position of said filter cartridge in said housing; and, heat source means connected to said housing for regenerating said filter cartridges by burning free material trapped in said filter cartridges.

2. A particle filter according to claim 1, wherein said support tubes are lined with filter material over varying widths with respect to a longitudinal direction of each support tube.

3. A particle filter according to claim 1, wherein said filter cartridges are arranged distributed in said housing corresponding to a flow profile of exhaust gas flow through said housing, said flow profile being defined by said inlet chamber and said outlet.

4. A particle filter according to claim 1, wherein said active length of said filter cartridges is defined by a length of filter material, support tubes arranged in an outer region of said housing having a shorter filter material coating than support tubes arranged in an inner zone of said housing.

5. A particle filter according to claim 1, wherein each of said support tubes includes a plurality of perforations, said perforations extending along a length of said support tubes corresponding to a length of filter material provided on said support tubes.

* * * * *